US007039213B2

(12) United States Patent
Hyre et al.

(10) Patent No.: US 7,039,213 B2
(45) Date of Patent: May 2, 2006

(54) SPEAKER DRIVER

(76) Inventors: David E. Hyre, 8314 21st Ave. NW., Seattle, WA (US) 98117; Daniel C. Wiggins, 20330 77th Ave. NW, Edmonds, WA (US) 98026

( * ) Notice: Subject to any disclaimer, the term of this patent is extended or adjusted under 35 U.S.C. 154(b) by 161 days.

(21) Appl. No.: 10/051,735

(22) Filed: Jan. 16, 2002

(65) Prior Publication Data

US 2003/0133587 A1 Jul. 17, 2003

(51) Int. Cl.
*H04R 25/00* (2006.01)

(52) U.S. Cl. ..... 381/414; 381/412

(58) Field of Classification Search ..... 381/414, 381/420, 412, 419, 413
See application file for complete search history.

(56) References Cited

U.S. PATENT DOCUMENTS

| | | | | |
|---|---|---|---|---|
| 3,201,529 | A | 8/1965 | Suhr | |
| 3,310,639 | A * | 3/1967 | Collins | 381/420 |
| 3,803,522 | A * | 4/1974 | Rooney | 335/231 |
| 3,983,337 | A | 9/1976 | Babb | |
| 4,017,694 | A * | 4/1977 | King | 381/415 |
| 4,188,711 | A | 2/1980 | Babb | |
| 4,225,756 | A | 9/1980 | Babb | |
| 4,327,257 | A | 4/1982 | Schwartz | |
| 4,334,127 | A | 6/1982 | Shimada et al. | |
| 4,661,973 | A * | 4/1987 | Takahashi | 379/194 |
| 4,783,824 | A * | 11/1988 | Kobayashi | 381/402 |
| 4,914,707 | A | 4/1990 | Kato et al. | |
| 4,980,921 | A * | 12/1990 | Zwicky | 381/414 |
| 5,119,431 | A | 6/1992 | Hamby | |
| 5,151,943 | A | 9/1992 | Van Gelder | |
| 5,550,332 | A | 8/1996 | Sakamoto | |
| 5,664,024 | A | 9/1997 | Furuta et al. | |
| 5,740,265 | A | 4/1998 | Shirakawa | |
| 5,748,759 | A | 5/1998 | Croft et al. | |
| 5,748,760 | A | 5/1998 | Button | |
| 5,832,096 | A | 11/1998 | Hall | |
| 6,269,168 | B1 * | 7/2001 | Tagami | 381/412 |
| 2002/0039431 | A1 * | 4/2002 | Chang | 381/412 |
| 2003/0152246 | A1 * | 8/2003 | Tanabe | 381/412 |

* cited by examiner

*Primary Examiner*—Sinh Tran
*Assistant Examiner*—Phylesha L Dabney
(74) *Attorney, Agent, or Firm*—Jensen & Puntigam PS

(57) ABSTRACT

An electro-mechanical transducer, including a magnetic assembly producing a magnetic field having two or more displaced regions of greater intensity, having magnetic flux in substantially similar directions, separated by and surrounded by regions of lower intensity magnetic field, and an electrically conductive and mobile member disposed in and capable of moving through a magnetic field.

11 Claims, 11 Drawing Sheets

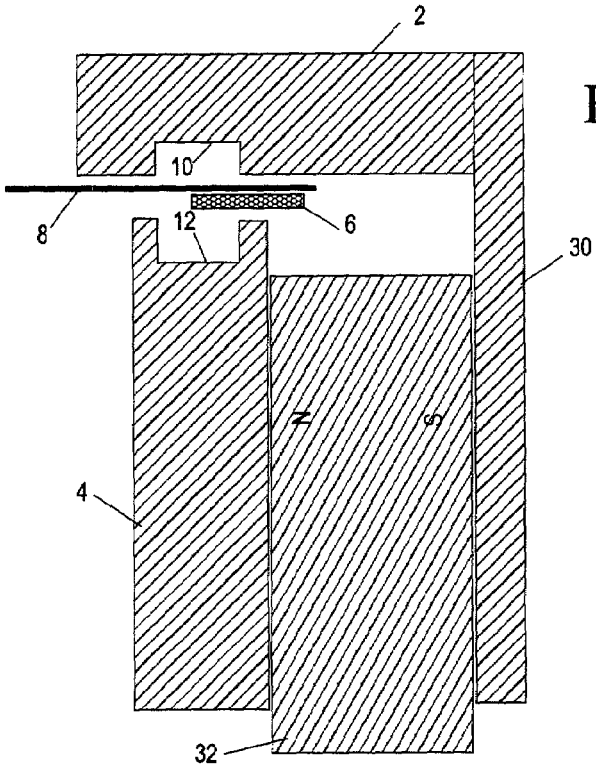
FIG.7
FIG.8
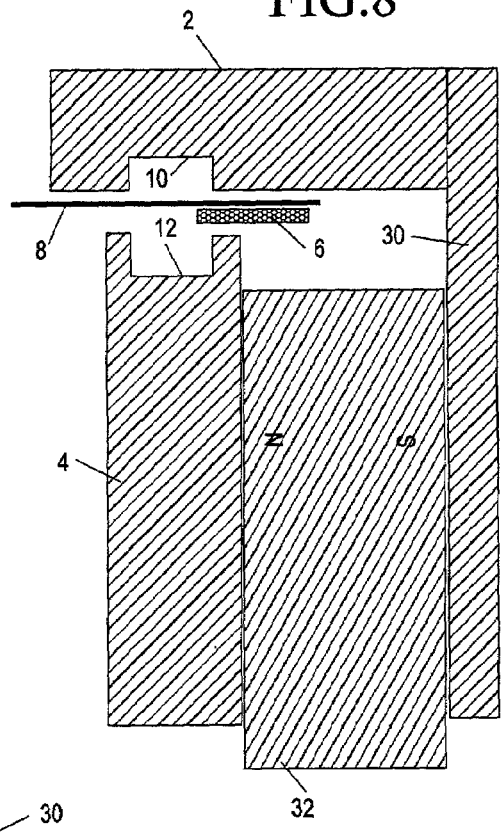
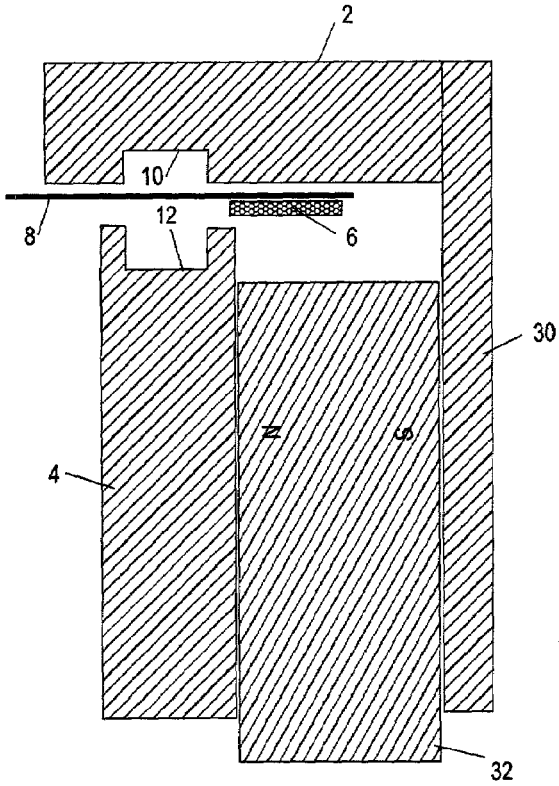
FIG.9

FIG.10A
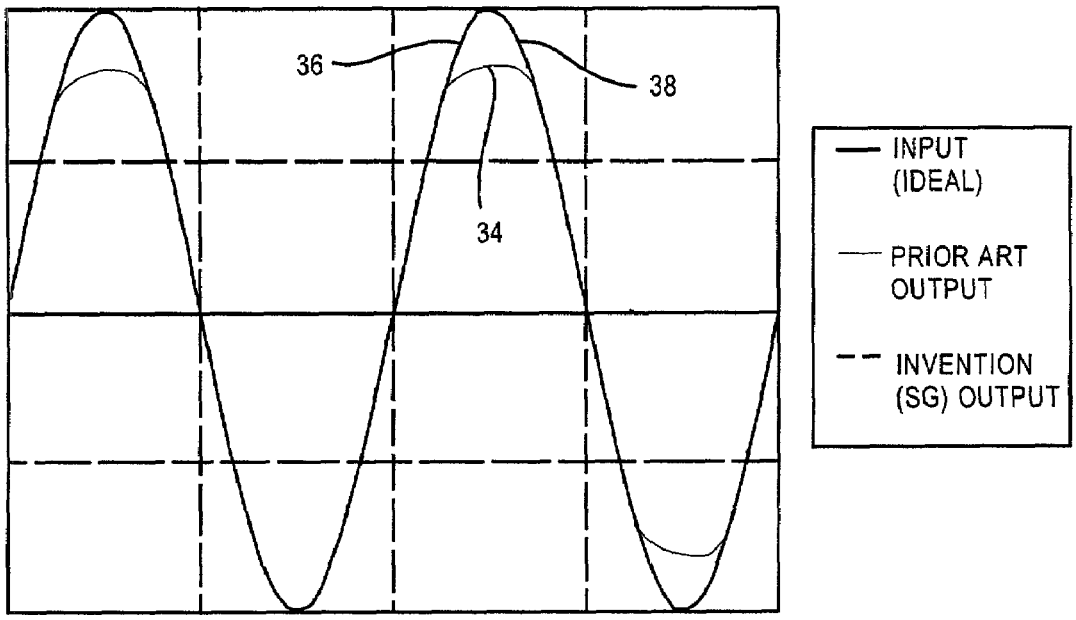
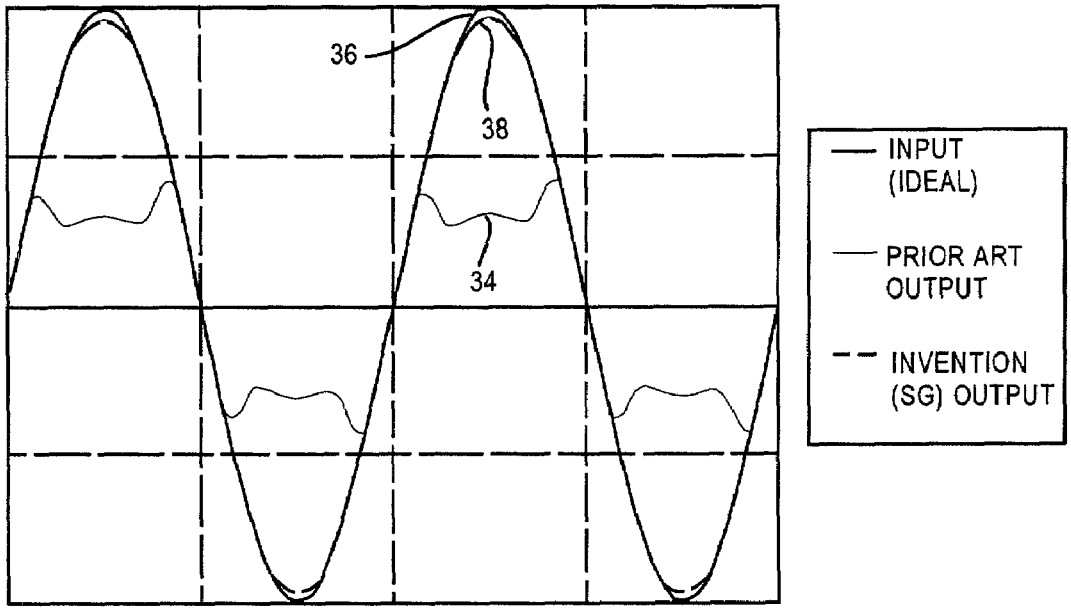
FIG.10B

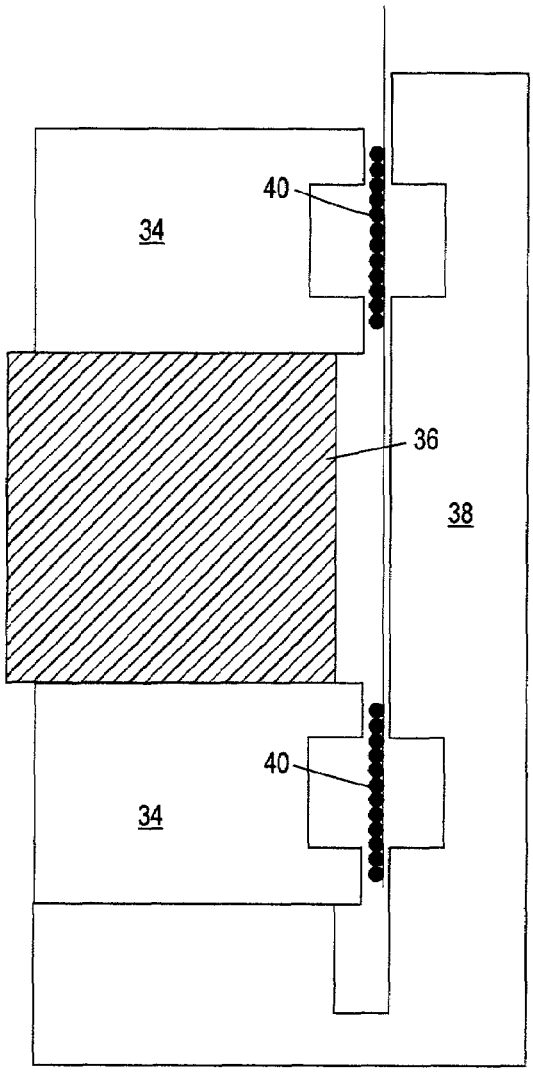
FIG.14
FIG.15
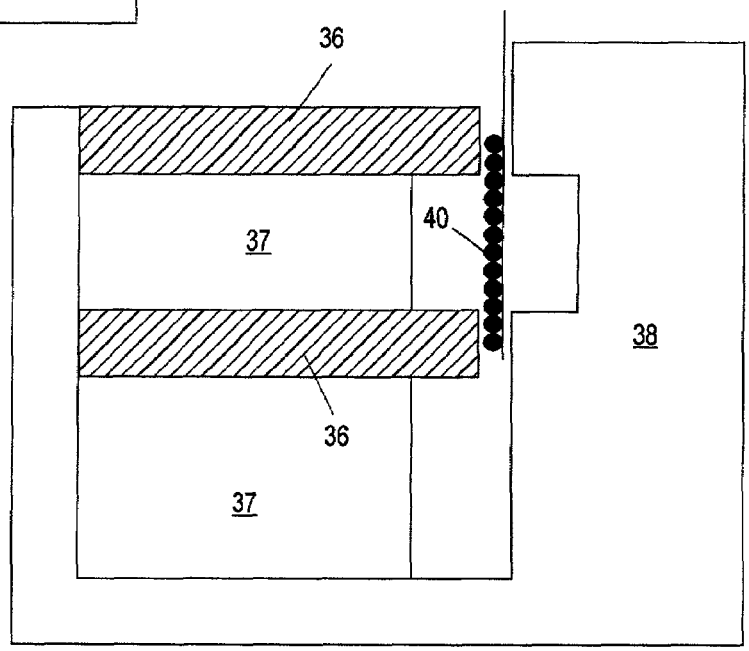

SPEAKER DRIVER

TECHNICAL FIELD

This invention relates to voice-coil type motors, and more particularly, to a voice-coil motor in an audio speaker that includes opposing gaps in the core and top plate creating a response having less distortion using a shorter coil.

BACKGROUND OF THE INVENTION

It has long been the desire to produce an improved audio speaker, i.e., one that effectively reproduces the input waveform without distortion over a wide frequency range. In general, the acoustic speaker system includes a current-carrying conductor, most commonly a coil, that reacts to the flux of a permanent magnet in the motor by axially moving in response to the amount of current in the coil, i.e. the Lorentz force B·I. In general, as the coil moves it drives a diaphragm, which creates the sound as a vibration in the air.

Distortions in the reproduced waveform are created by a number of causes, of which non-linear force and frequency imbalance are large contributors. A major factor in causing the speaker to have non-linear force is the coil moving outside the flux of the magnetic circuit, thereby reducing the B field+interacting with the current in the coil. This reduces the force generated and thus creates movement inconsistent with the original waveform. This is exacerbated at the lowest frequencies, where large excursions become necessary to produce sound. Indeed, the displaced volume required for a given volume level scales as the inverse square of the frequency ($Vd \propto 1/f^2$), thus requiring a driver to excurse four times as much to reproduce a signal at half the frequency. Ideally, for any driver, the force would remain constant over the required excursion, and would do so to large displacements in units requiring large excursion. This has been difficult and expensive to achieve with existing art.

Likewise, the inductance of a coil of wire, which is proportional to the length of that coil, reduces the current of high frequency signals flowing through the coil because of the increasing impedance from this inductance. This causes an increasing loss of force at higher frequencies, which distorts the signal by removing the upper frequency components to an increasing degree, distorting both the shape of the waveform and the frequency response. In extreme cases, the structure of the speaker causes excursion of the coil to modulate its inductance by position, causing an additional intermodulation distortion between low and high frequencies. Ideally, lower inductance is better, and the modulation of that inductance with position should be minimal. This has been difficult and expensive to achieve with existing art.

Various attempts have been made to solve non-linear excursion problems by increasing the length of the coil far beyond the size of the magnetic flux field (commonly referred to as "overhung"), or the reverse having a short coil in a long flux field ("underhung"), thereby allowing the coil to remain in the main flux over larger excursions. However, the longer coil leads to numerous additional problems, including increased mass, inductance, and intermodulation, and the attendant problems as stated above, as well as physical problems such as reduced tolerance to production variation and coil clearance from the rear of the speaker. The short coil in a long gap necessitates much larger and more expensive motor structures and is a less-than-ideal solution. Neither solution completely eradicates non-linearity in the force due to various magnetic effects.

As such, in general, most loud speaker systems that produce broad band audio energy utilize a plurality of acoustic drivers mounted within a common enclosure, each driver optimized for operation over its own limited band of frequencies. Each driver is driven through a crossover network to direct electrical signals with limited frequency content to the appropriate driver. These systems, using multiple speakers, have achieved considerable acceptance in the market place; however these systems are relatively expensive. Many attempts have been made in the past to design a single driver having a flat response over a wide band of frequencies driven by the potential advantages of lower cost, smaller size and the like. This has proven to be a difficult task because of the inherent conflict between the theoretically ideal system required to produce low frequency sound and that required to produce high frequency sound. To produce good low frequency sound you must move a relatively large mass of air by driving a large diameter rigid piston through a relatively long stroke; higher frequency requires a smaller diameter rigid piston driver through a shorter stroke. The displaced volume required for a given volume level scales as the inverse square of the frequency ($Vd \propto 1/f^2$). The theoretical criteria regarding the generation of high and low frequency sounds are in direct conflict. High frequency requires that the piston be accelerated at a high rate, thus ideally requiring a near-zero mass piston driven by a short coil, while low frequency requires lower acceleration of a larger, higher-mass piston through larger oscillatory amplitudes with a longer coil.

Whereas prior attempts to resolve the conflicts have focused upon reducing the mass and/or altering the suspension system and/or fabrication and mounting of the core and/or dividing the coil in half, it has been found by the inventors that utilizing what hereinafter will be called a "split gap design", wherein a groove or series of grooves is placed in the exterior portion of the core and a similar groove or series of grooves is placed in the interior surface of the plate, allows a much shorter coil to accomplish the same purpose with little or no modification to the remainder of the speaker structure.

References known to the inventor include:

U.S. Pat. No. 2,004,735, granted to Thomas Jun. 11, 1935, which discloses improvements to dynamic loudspeakers, including the use of an actively-energized coil to neutralize changes in the gap flux density caused by variations in the field of the voice coil.

U.S. Pat. No. 3,983,337, granted to Babb Sep. 28, 1976, which discloses a plurality of changes to improve the performance of a broad band acoustics speaker, including the use of a pair of spaced coils that are used to modulate distortions by increasing the time that the coils are within the flux.

U.S. Pat. No. 4,188,711, granted to Babb Feb. 19, 1980, discloses a novel suspension system for use in a dynamic loud speaker.

U.S. Pat. No. 4,225,756, granted to Babb Sep. 30, 1980 discloses the methods of fabricating a speaker coil structure, including a rigid adhesive coating that transmits high frequency.

U.S. Pat. No. 4,661,973, granted to Takahashi Apr. 28, 1987, discloses a utilization of a tapered surface on the pole of the yoke or separate tapered plates attached to the annular plate.

U.S. Pat. No. 4,914,707, granted to Kato et al Apr. 3, 1990, discloses a pair of separate plates between which is mounted a magnet, wherein said annular magnet is recessed from the inner surface of the plates which interact with a pair of spaced coils permeated by magnetic fields of opposite polarity.

U.S. Pat. No. 5,151,943, granted to Van Gelder Sep. 29, 1992, discloses an improved output power for a dynamic loud speaker by decreasing the second harmonic distortion through the introduction of nonferromagnetic shielding members.

U.S. Pat. No. 5,202,595, granted to Sim et al Apr. 13, 1993, discloses a voice coil motor which comprises a yoke member and a central portion forming magnetic path left/right fringes and upper/lower fringes, and moving coil member around the central portion of the yoke member the permanent yoke magnets being adhered to the upper/lower fringes of the yoke member, and the yoke members being formed by overlapping at least two members of different permeabilities so as to make uniform the reluctance of lines of magnetic force being generated from the permanent magnets and flowing through the yoke member.

U.S. Pat. No. 5,550,332, granted to Sakamoto Aug. 27, 1996, discloses a loud speaker assembly for low frequency reproduction, wherein two magnets magnetizing in the direction of thickness has magnetic poles of the same polarity disposed facing each other with a center plate made of a soft magnetic material interposed therebetween.

U.S. Pat. No. 5,604,816, granted to Totani Feb. 18, 1997, discloses a vibrator for a speaker system wherein the coil is inserted into the gap and the magnetic pole is supported to the casing by rubber, elastic bodies.

U.S. Pat. No. 5,748,760, granted to Button May 5, 1998, discloses an improved electromagnetic transducer, combining a properly designed housing, a neodymium magnet and a dual coil structure also permeated by magnetic fields of opposite polarity.

U.S. Pat. No. 5,740,265, granted to Shirakawa Apr. 14, 1998, discloses a loud speaker unit, including a magnetic system of dual magnetic gaps formed with a permanent magnet creating magnetic fields of opposite polarity.

SUMMARY OF THE INVENTION

With the above-noted prior art in mind, it is an object of the present invention to provide an electro-mechanical transducer capable of producing a more linear response over a larger excursion and wider bandwidth with lower distortion, comprising a magnetic assembly, producing a magnetic field having two or more axially displaced regions of greater intensity (generally referred to as a "gaps"), being substantially similar in size, magnitude and direction and separated by and surrounded by regions of lower intensity magnetic field. The assembly is supported by a frame which is either separate or integral and the magnetic assembly includes an electrically conductive and mobile coil disposed in the magnetic field and capable of moving through the magnetic field, and an acoustic radiating diaphragm is attached to and moves with the coil member and the diaphragm is mounted or sealed to the frame to reduce or eliminate air leaks, and either with or without an additional suspending element secured to the frame to provide additional restorative and/or centering force.

It is another object of the present invention to provide an electro-mechanical transducer, wherein the magnetic field, having two or more axially displaced regions of greater intensity, and being similar in size, magnitude and direction, and separated by regions of lower intensity magnetic field which may be of substantially different sized and/or magnitude field includes a central pole, back plate, magnetic material, and top plate and wherein the central pole and the top plate include opposing grooves past which the coil moves to transduce sound.

It is another object of the present invention to provide a non-audio electro-mechanical transducer based upon the same principles, wherein a magnetic field is created having two or more axially displaced regions of greater intensity past which current-carrying conductor moves.

It is a further object of the present invention to provide a non-audio electro-mechanical transducer wherein opposing magnetic materials include opposing grooves past which the current-carrying conductor moves.

BRIEF DESCRIPTION OF THE DRAWINGS

FIGS. 3–9 depict the position of the coil with respect to the split gap to coordinate with the position shown on FIG. 2.

FIG. 10 graphs the waveforms that would be generated by a transducers based on prior art and on the new invention, with each moving a total of 0.84 coils lengths (i.e. +/−0.42 lengths, 0.42 lengths of the voice coil forward of center plus 0.42 lengths to the rear of center; top graph) or 1.68 coil lengths (+/−0.84 lengths; bottom graph).

FIGS. 12–17 depict other physical configurations to which the inventive concept is beneficial.

BEST MODE FOR CARRYING OUT THE INVENTION

Figure 1:
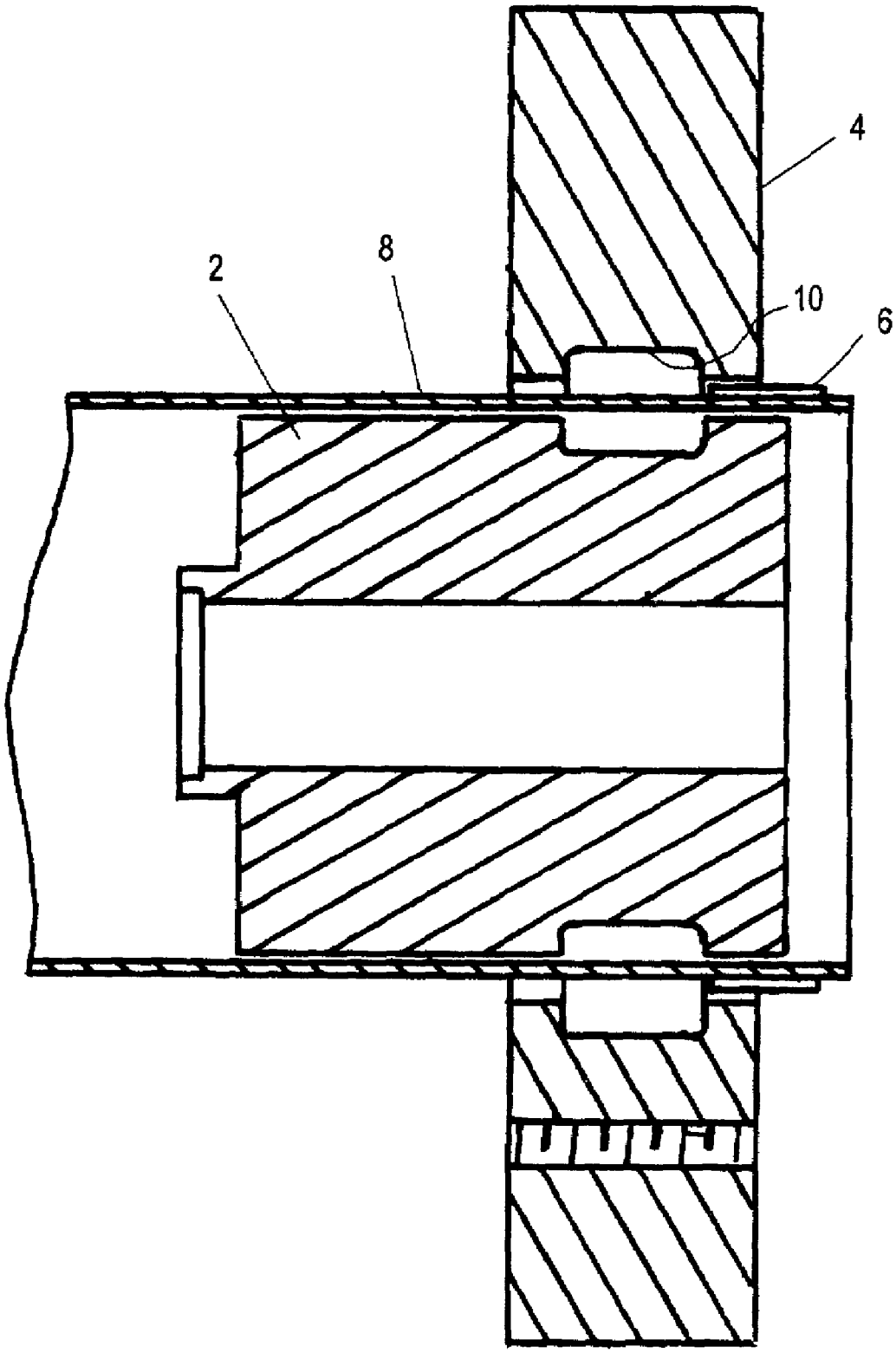
FIG. 1 is a cross sectional view of the core of a broad band speaker.

As seen in FIG. 1, the present invention is shown in a simplified drawing that shows the core of the speaker 2, a top plate 4, a coil 6 and the coil form 8. The invention comprises placing opposing gaps 10 and 12 in the top plate and core, respectively, such that when the coil 6 passes therethrough in its response to the magnetic force, the sound is produced with less distortion. Further advantages are in the economics of the current invention in that the physical size can be less, the coil can be shorter, thereby reducing the overall cost and physical size of the speaker motor. As noted hereinabove, the size of the speaker motor is critical in that smaller size introduces less inertia, enabling a more harmonic response.

Figure 1A:
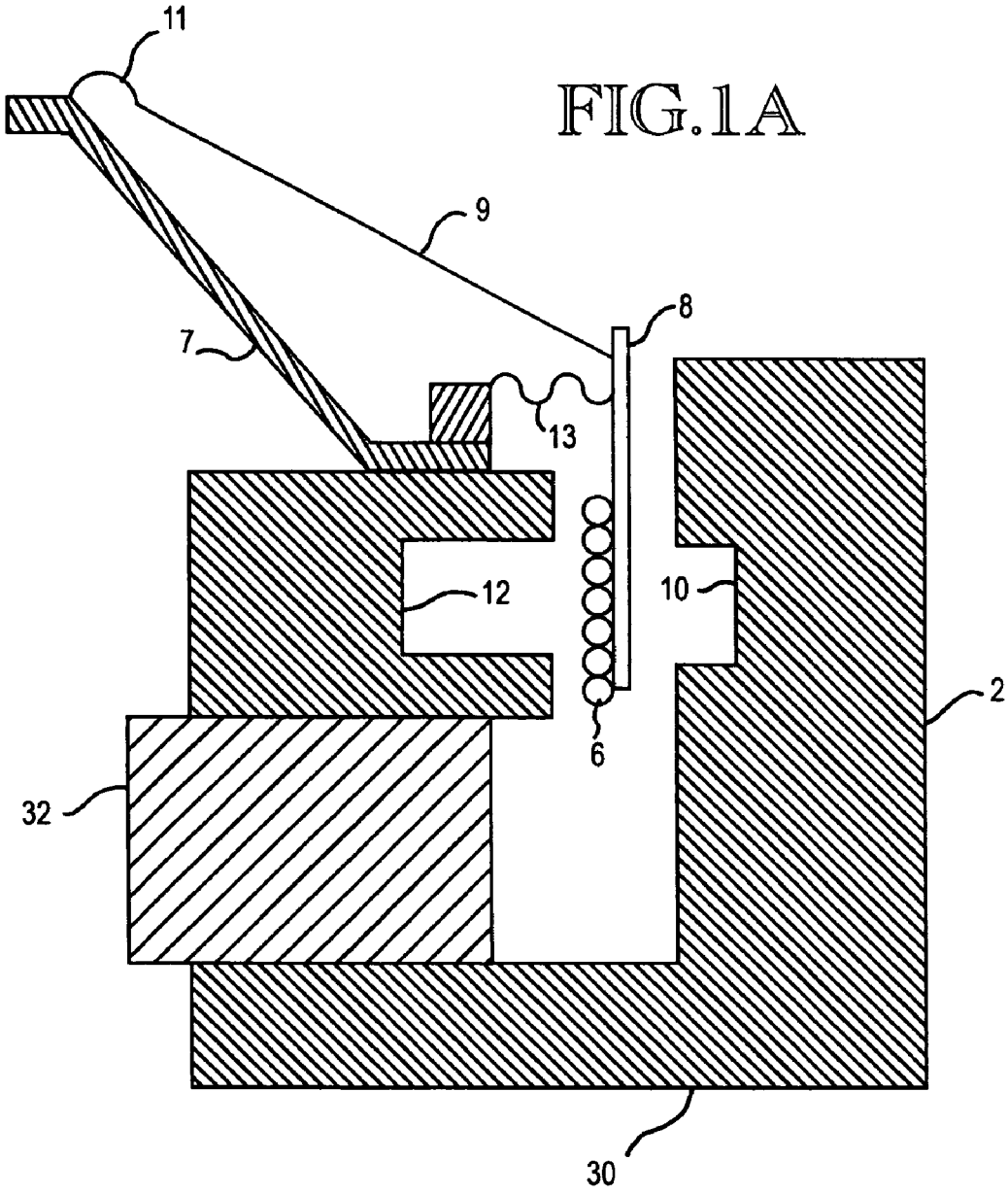
FIG. 1A depicts the speaker motor of FIG. 1 attached to a supporting frame.

As seen in FIG. 1A, the speaker motor as described with respect to FIG. 1 is attached to a supporting frame 7, an acoustic radiating diaphragm 9 including an air seal 11. A suspending element 13 is also provided.

For clarity, four different speaker configurations including the current invention are shown in graph 2, wherein the coil position, in units of coil length, is graphed versus the generated BL (normalized to 1), which is the magnetic flux density B times the effective length of the wire L in the magnetic field. It is proportional to motor strength per unit current; it generates a force of B×L×I. The more constant and flat the BL curve, the more linear the motor and the lower the distortion. A common standard is to define maximum effective travel by the points on either side of center at which BL decreases by 3 dB, where it generates 70.7% of maximum force. This correlates roughly with the onset of perceptible distortion.

Figure 2:
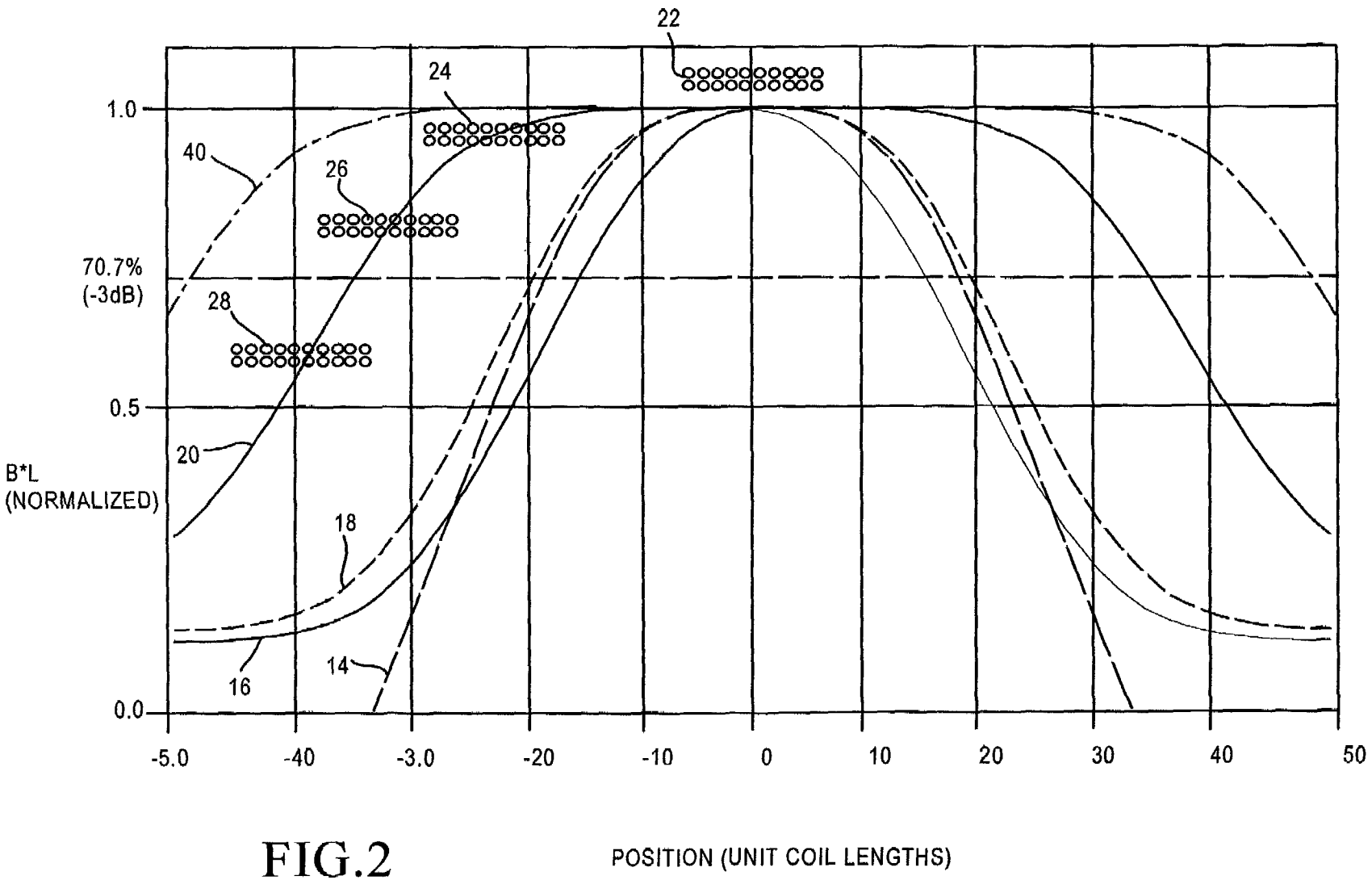
FIG. 2 is a graphical representation showing the voice coil position versus the BL (motor force) showing the BL curve for various speaker configurations.

FIG. 2 line 16 shows the position of one coil in one gap, which is from a motor of common design, wherein one (1.0) unit of coil length gives approximately 0.84 units (+/−0.42) of effective travel before the 70.7% point is reached. The waveform generated by this coil moving 0.84 units (+/−0.42) is shown in FIG. 10, line 34. Compared to the ideal waveform (input signal, line 36), the output is clearly distorted, even at this modest excursion.

In FIG. 2, line 14 is for the prior-art arrangement of two coils disposed in two gaps of opposite flux direction, which does not gain appreciable excursion. There are several variants on this depending on the position of the coils within the structure, however, these changes don't alter the operation noticeably. One (1.0) unit of coil length is estimated to give 1 unit of effective travel (+/−0.5).

FIG. 2 graph line 18 depicts the configuration of two coils/one gap, which is similar to line 16, except the coil is separated into two halves. Excursion does increase somewhat, though not much; it becomes saddle shaped if extended anymore than the current graph. One (1.0) unit of coil is estimated to give approximately 1.05 units (+/−0.525) of effective travel with a gap length equivalent to that for line 16.

FIG. 2 graph line 20 is one coil/two gaps (the current invention), wherein one (1) unit of coil gives approximately 1.84 units (+/−0.92) of travel and is nearly flat over a much broader region, which equates to lower distortion. This is one of the numerous goals of this invention; flatter BL and lower distortion. The decreased distortion can be seen in waveform 38 of FIG. 10 and how it more closely reproduces the input waveform (line 36). In fact, excursion must be increased to 1.68 units (+/−0.84) before the output becomes visibly distorted (FIG. 10 graph 2 line 38), where prior art (line 34) bears little resemblance to the original waveform (line 36).

The invention addresses distortions caused by inductance variations by having the conductor shortened and generally within the top plate, this allows a pole of modest length to remain completely surrounded by the conductor over a significant portion of its travel, minimizing changes in the amount of ferromagnetic material enclosed within the conductor and thus the variation in its inductance during excursion. As described above, this reduces distortion of the reproduced waveform.

FIG. 2 graph line 40 is also according to the current invention, having one coil and multiple gaps, but in this case utilizing three (3) gap regions instead of the two described above. This further extends the motion of the coil, in this case to 2.9 units (+/−1.45) of travel. It is easily seen that any number of gaps is possible, each adding to the performance of the motor by increasing the excursion per unit conductor, allowing more excursion for a given conductor length or the same excursion with a shorter conductor length relative to existing art.

Figure 11:
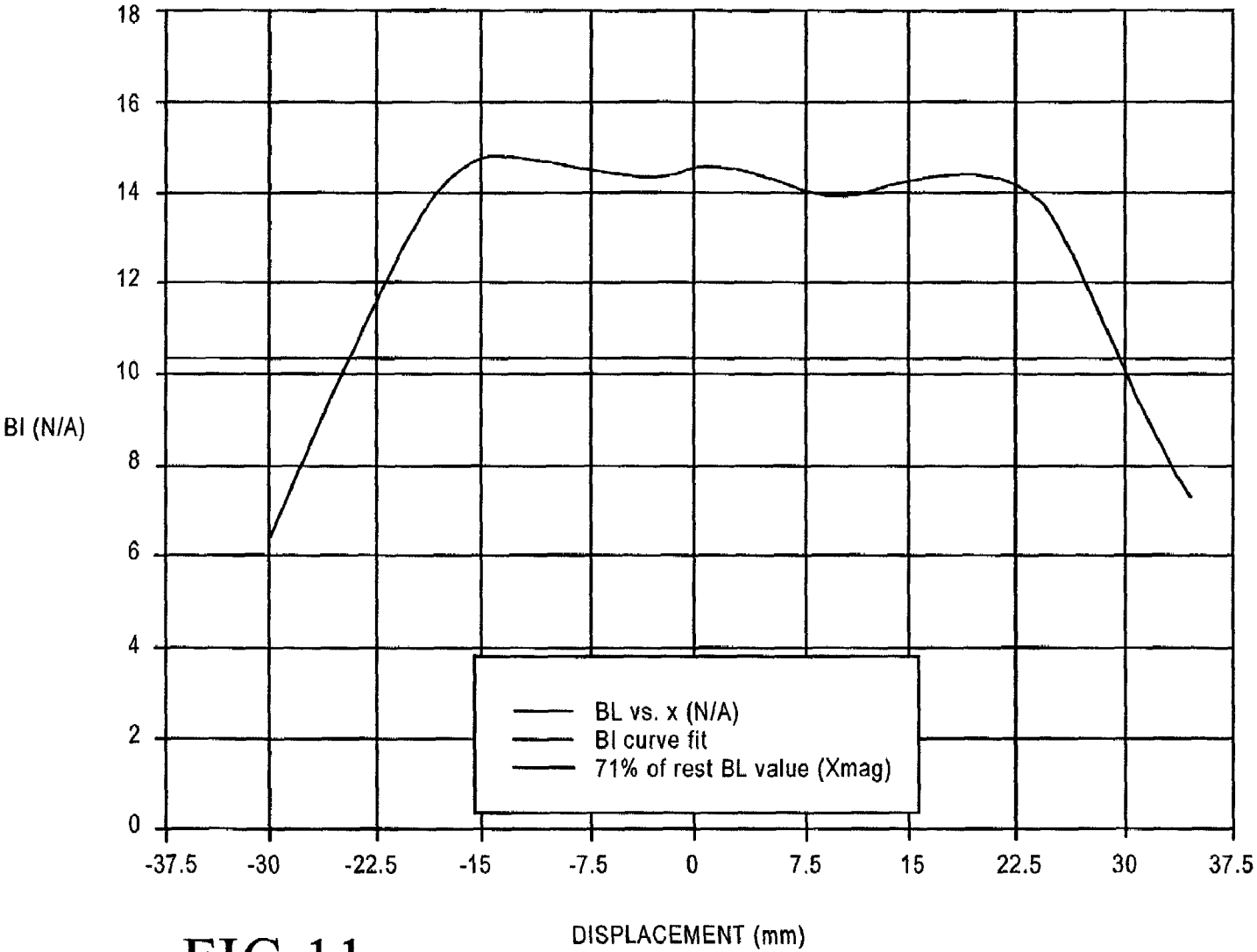
FIG. 11 graphs the actual BL versus position measured on a research prototype utilizing the new invention with a 26.7 millimeter coil.

As one example of the invention, not intended to limit the scope of the patent, when the abstract description above is translated into a working prototype loudspeaker unit using a modest coil length of 26.7 millimeters and two gaps, the measured excursion is observed to exceed that of prior art with a 38 millimeter coil, with BL remaining flat across the center 40 millimeters of travel to within a few percent (FIG. 11). This prototype achieves 55 millimeters (+/−27.5) of travel with the 26.7 millimeter coil.

Figure 3:
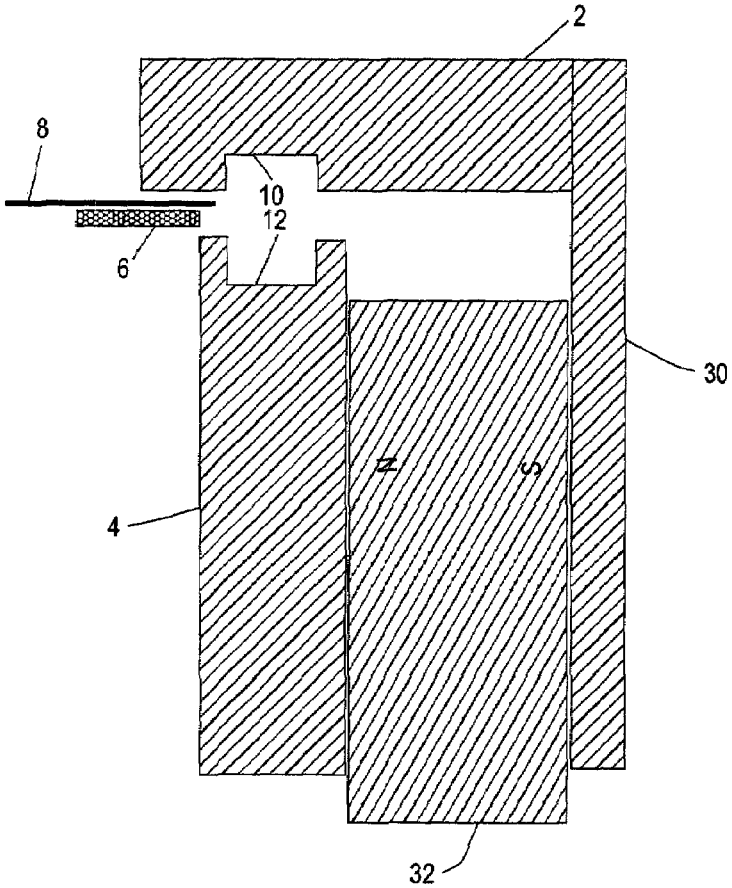
Figure 4:
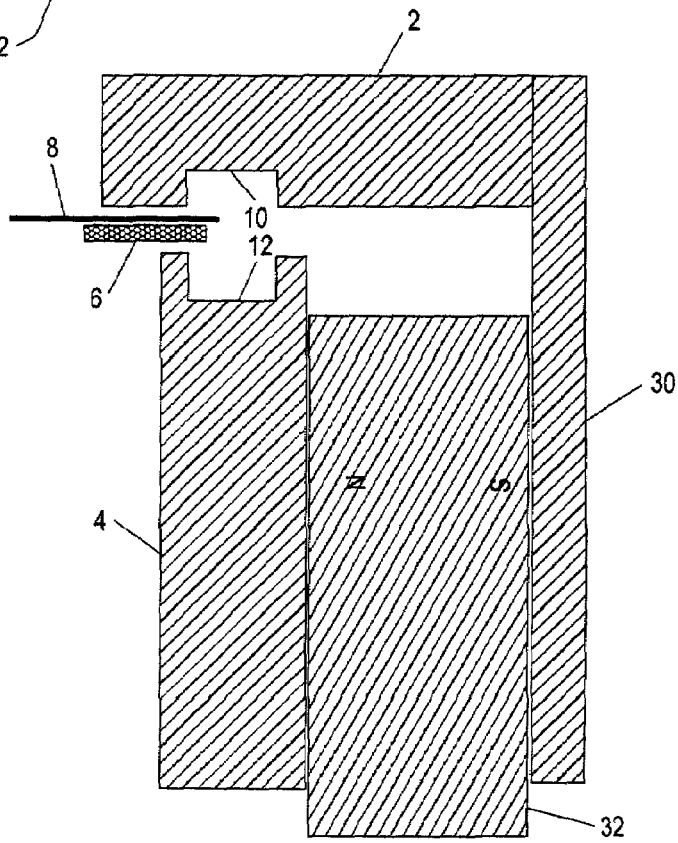
Figure 5:
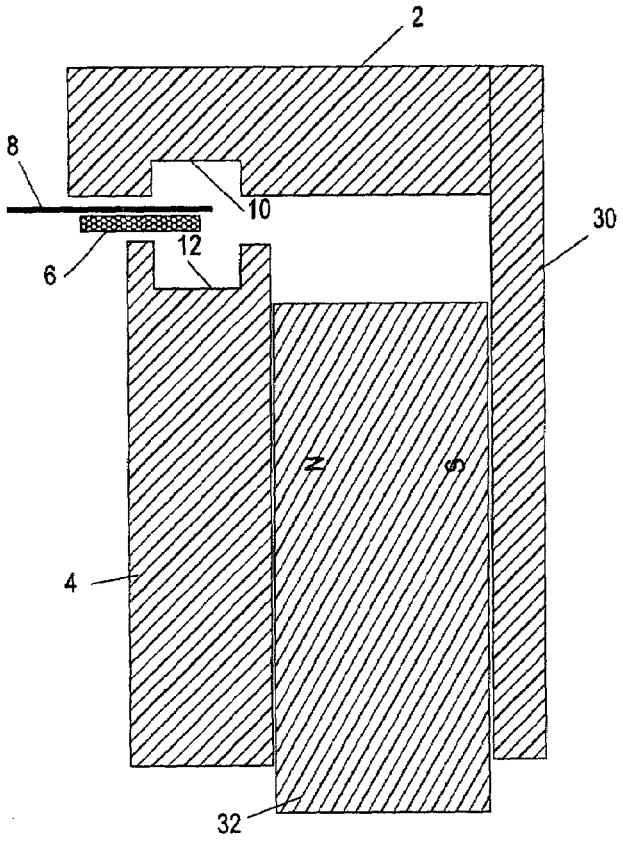
Figure 6:
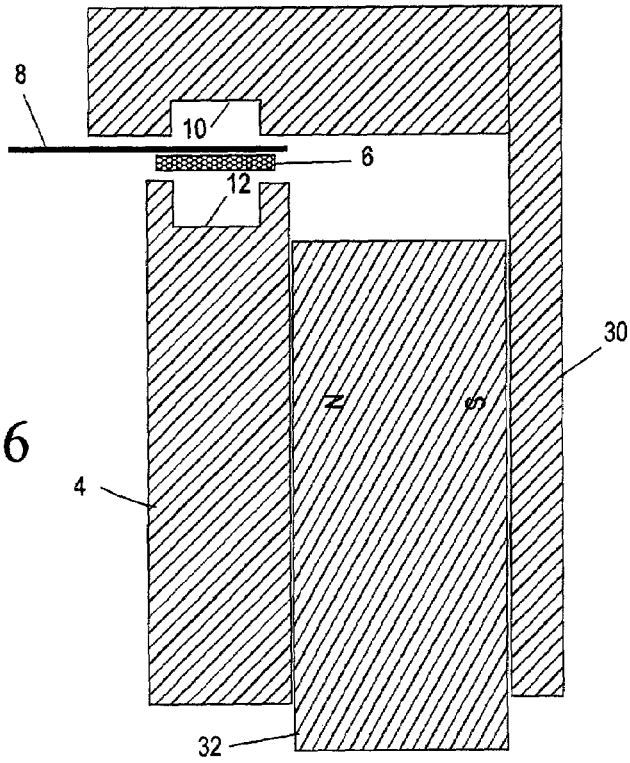

Although the current invention shares features of each of the designs above, it represents a new arrangement and its actual working is quite different. The key is that, as it moves, the voice coil gains the exact same amount of BL on the forward end as it is losing on the rear end, and does not require a constant flux. In prior art, flux gain and loss were not symmetrical, and partly therefore did not perform as the current invention. Likewise seen in FIG. 2 are simulated positions of the coil relative to the gap for the various configurations and position 22 is the coil as shown in FIG. 6, position 24 as in FIG. 7, position 26 as is FIG. 8, and position 28 as is FIG. 9. FIGS. 3–5 would be shown at the opposite sides of the curves and are omitted for clarity.

Referring now to FIGS. 3–9, a partial sectional view is shown, wherein the core 2 includes gap 10; the top plate 4, includes gap 12; the core 2 is secured to bottom plate 30 and the coil 6 is secured to the coil former 8.

It is to be understood that in the most likely form of the invention applied to common audio transducers, the core 2 is cylindrical and that the elements 4 and 30 are disks and plates and the magnet 32 is likewise a flat, hollow cylindrical shape.

Figure 12:
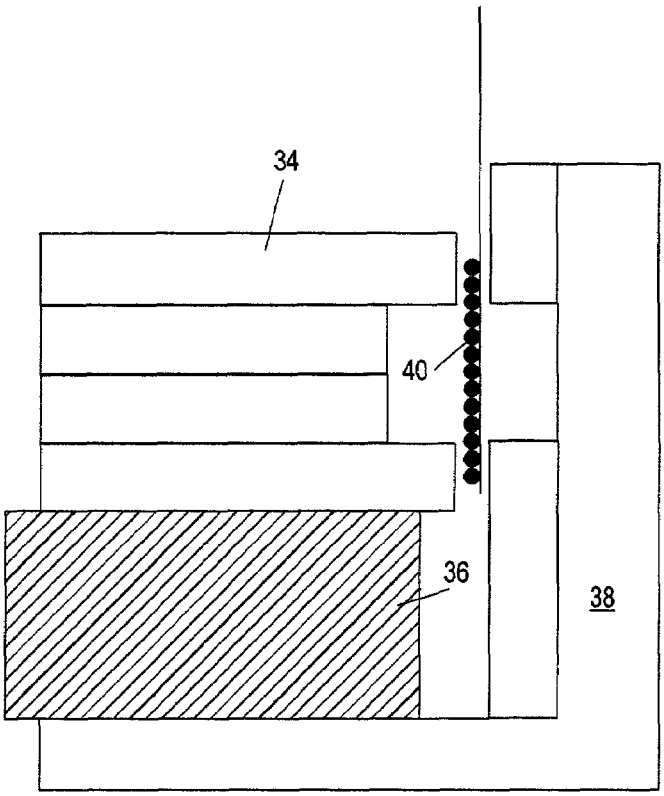
Figure 13:
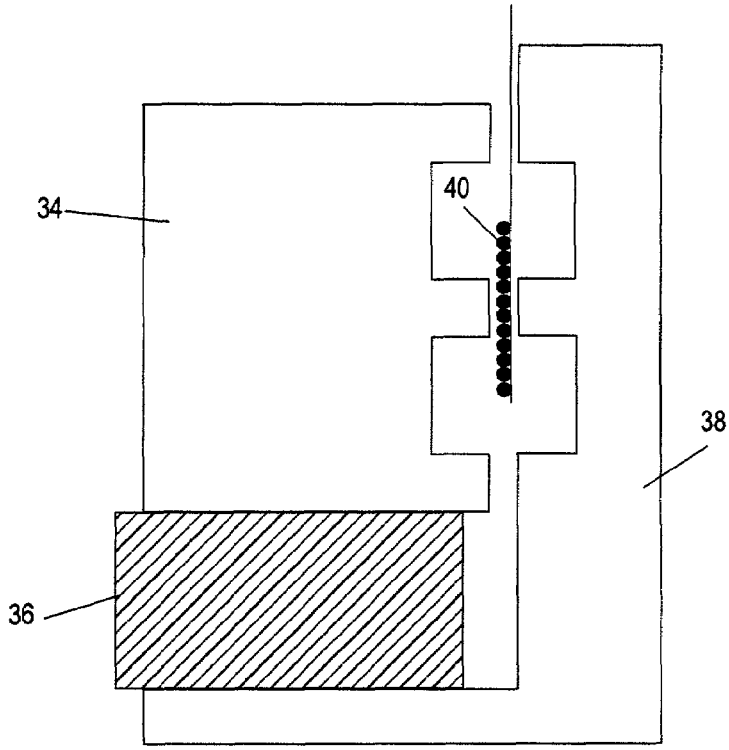
Figure 16:
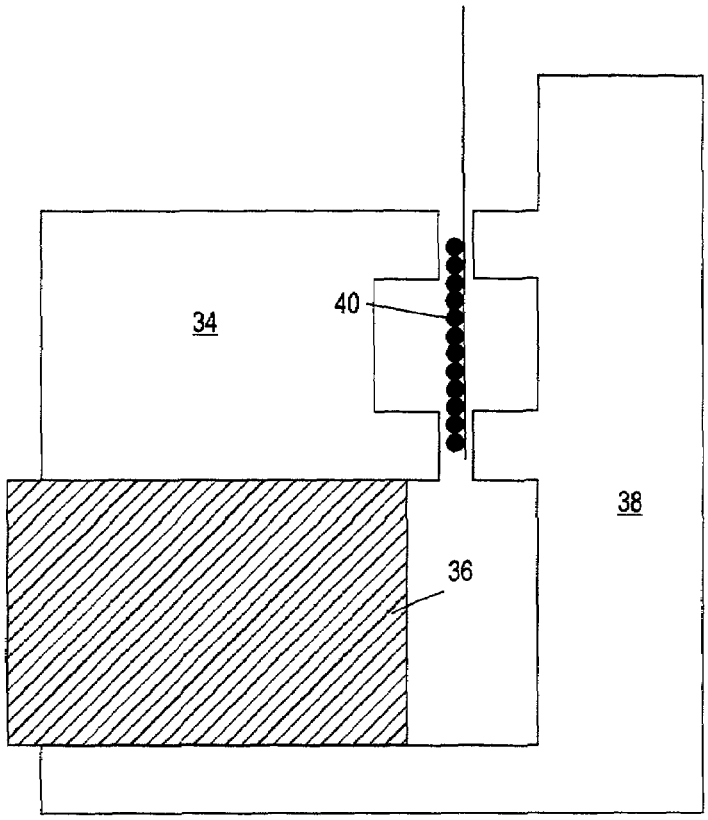
Figure 17:
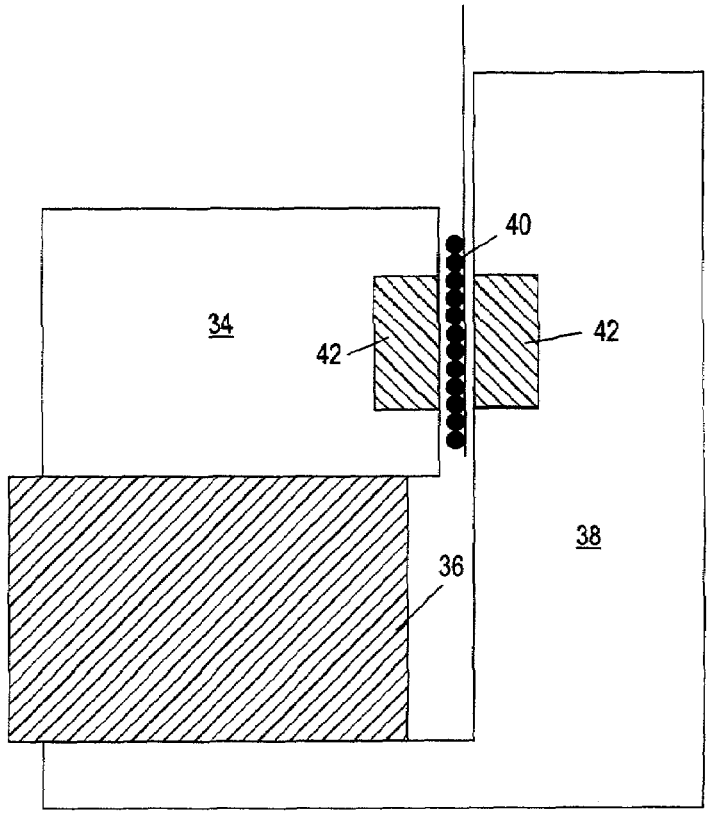

Other configurations include, as shown in FIG. 12, a laminated top plate assembly with the top plate designated as 34, the magnet 36, the pole piece and back plate 38 and the voice coil as 40. Similar numerical designations are used in FIG. 13; FIG. 14, with dual split gaps; FIG. 15 with a radial split gap, including nonferrous spacers 37; FIG. 16, with an external rebate pole piece; and FIG. 17 with a filled split gap, wherein 42 is a nonferrous electrically conductive material.

However, the circular nature and the position of parts are only one of many arrangements that will produce the stated benefits; the benefits derive from the division of the magnetic field into two or more parts with the same direction of flux and do not depend on arrangement or general geometry of the motor. The top plate and pole are to be understood as representative of opposite poles of a magnetic system and not limited to annular loudspeaker motors. Likewise, the magnet is understood to be any material or device capable of producing magnetic flux. Ovoid, linear, and other geometries benefit just as readily, as do other arrangements of magnetic materials that create a divided magnetic field such as potted, central, and edge-gap permanent magnets. Actively-magnetized (i.e. with electrical current) arrangements will likewise benefit. In addition, this invention also specifically covers the new magnetic arrangement in combination with coils of different lengths relative to the gaps and grooves, the length varying depending on the design goal, as this is observed to alter the performance in various desirable ways and can intentionally be used to achieve a particular desired result of BL curve and distortion characteristics. Other changes to improve function are not mutually exclusive and would still allow operation by the same principles disclosed herein. This invention has utility when applied to all sizes and types of linear magnetic actuators, both audio and non-audio. This includes the full range of audio transduction devices: tweeter, midrange, woofer, headphone, microphone, etc. It is also applicable to non-standard audio transducers that utilize current-carrying wires disposed in magnetic gaps, such as those without traditional cylindrical coils (e.g. U.S. Pat. No. 4,903,308). Possible non-audio applications include but are not limited to linear actuators and hard-drive recording head actuators.

Numerous practical, but not limiting, guidelines can be given to assist in the most common implementations of the invention. The grooves can be of any depth, but only need be of sufficient depth so as to reduce flux density to a level consistent with the desired degree of BL flatness & excursion. The nominal depth for most applications will be that each groove be of depth equal to or greater than the span (width) of the gap from pole to pole relative to the adjacent pole. Shallower grooves will still operate in split-gap mode and give some benefit.

The nominal conductor axial length (coil length) is approximately equal to the groove width plus the average flux-peak width, adjusted for the mismatch between groove flux strength & asymmetry, and also for desired response shape and level of nonlinearity, shorter lengths enhancing BL at larger excursions and longer at smaller. The system is readily modeled by common finite element and standard mathematical methods to determine the optimum for the given conditions and materials.

Mentioned above, nonlinear motor behavior would be desirable under certain conditions for a number of reasons. For example, other nonlinearities in the system could be canceled by appropriate shaping of the BL profile through adjustment of the split-gap motor geometry, most particularly the conductor axial length. Likewise, judicious shaping of the BL profile would exert better control of and electromagnetic damping on the conductor during motion through particular regions of its travel. Nor is the conductor limited to a simple, single contiguous cylinder of constant winding density or pattern for operation in split-gap mode.

Thus, as can be seen, even though the physical modification to the speaker motor is relatively minor and straightforward, the results are significant and largely unexpected, creating a new principle of operation.

Although the mode described above for carrying out the invention relates one structure in detail, it will be understood by those skilled in the art that various changes, substitutions, alterations, and combinations with other art can be made therein without departing from the general spirit and scope of the invention as defined by the following claims and embodied by the preceding descriptions.

The invention claimed is:

1. An electro-acoustic transducer comprising:

a magnetic assembly, created by a central pole, back plate, magnetic material and top plate, producing a magnetic field, that field having two or more displaced regions of greater intensity, wherein both the top plate and central pole produce the regions of varying magnetic intensity, those regions having magnetic flux in substantially similar directions, and separated and surrounded by regions of lower-intensity magnetic field;

a supporting frame; and wherein an electrically-conductive and mobile member disposed in the magnetic field is capable of moving through the magnetic field, and further including;

an acoustic-radiating diaphragm attached to and moving with the electrically conductive and mobile member;

an air seal at the edge of the diaphragm; and a suspending element to provide restoring force to the moving parts.

2. An apparatus of claim 1, wherein the top plate and center pole include opposing surface grooves.

3. An apparatus of claim 1, with the magnetic field intensity between the regions of lower intensity and those outside these regions being substantially similar in size and/or magnitude.

4. An apparatus of claim 1, with the magnetic field intensity between the regions of greater intensity and those outside these regions being substantially different in size and/or magnitude.

5. An apparatus of claim 1, with the field intensity between the regions of greater intensity less than the regions of greater intensity.

6. An apparatus of claim 1, with a magnetic field intensity outside the regions of greater intensity less than the regions of greater intensity.

7. An apparatus of claim 1, with paramagnetic material in at least one region of lower flux.

8. An apparatus of claim 1, with diamagnetic material in at least one region of lower flux.

9. An apparatus of claim 1, wherein regions of multiple flux maxima are repeated in an axially-displaced location but with flux in the opposite direction, thereby creating a structure have 4 or more regions of greater intensity and half of which have flux opposite that of the other half, each grouping having its own attendant coil.

10. An apparatus of claim 1, wherein the pole has additional grooves beyond those in the top plate.

11. An apparatus of claim 1, wherein the top plate has additional grooves beyond those in the pole.

* * * * *